US012773616B2

(12) United States Patent
Blythe

(10) Patent No.: US 12,773,616 B2
(45) **Date of Patent: *Oct. 27, 2026**

(54) WRIST PLAY CALLER

(71) Applicant: DRYMAX TECHNOLOGIES, INC., Paso Robles, CA (US)

(72) Inventor: William A. Blythe, Paso Robles, CA (US)

(73) Assignee: DRYMAX TECHNOLOGIES, INC., Paso Robles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/661,528

(22) Filed: May 10, 2024

(65) Prior Publication Data

US 2024/0293724 A1 Sep. 5, 2024

Related U.S. Application Data

(63) Continuation of application No. 17/573,395, filed on Jan. 11, 2022, now Pat. No. 11,986,718.

(51) Int. Cl.
*A63B 71/06* (2006.01)

(52) U.S. Cl.
CPC .. *A63B 71/0619* (2013.01); *A63B 2071/0663* (2013.01); *A63B 2071/0694* (2013.01); *A63B 2209/10* (2013.01); *A63B 2225/68* (2013.01)

(58) Field of Classification Search
CPC ..... A63B 71/0619; A63B 2071/0663; A63B 2071/0694; A63B 2209/10; A63B 2225/68

(Continued)

(56) References Cited

U.S. PATENT DOCUMENTS 2,643,389 A * 6/1953 Oscar ..... A41D 20/00 2/170
4,047,400 A * 9/1977 Thorneburg ..... A41D 20/00 66/190

(Continued)

FOREIGN PATENT DOCUMENTS

GB 2442937 A 4/2008

OTHER PUBLICATIONS

You Tube "Wrist Coach Youth Triple Play", https://www.youtube.com/watch?v=e0lm9LQoxQ; Mar. 23, 2011 (Year: 2011).*

(Continued)

*Primary Examiner* — Nini F Legesse
(74) *Attorney, Agent, or Firm* — Christopher J. Knors; Moore & Van Allen PLLC

(57) ABSTRACT

The article is a tubular construct of knitted or woven yarns irreversibly attached thereto a play caller. The play caller comprises a polymeric base sheet having a length and a width, the polymeric base sheet having a first major surface and a second major surface, and a plurality of second polymeric sheets having a length and a width less than or equal to the length and width of the polymeric base sheet. The plurality of second polymeric sheets are separated from each other by a distance and coupled to the second major surface of the polymeric base sheet along at least one of their widths or lengths defining a plurality of pockets, the pockets having openings and at least a portion of the play caller is irreversibly coupled to the tubular construct. Methods of constructing the article are also described.

3 Claims, 14 Drawing Sheets

(58) Field of Classification Search
USPC ..... 473/422, 450
See application file for complete search history.

(56) References Cited

U.S. PATENT DOCUMENTS

| | | | | |
|---|---|---|---|---|
| D299,888 | S | 2/1989 | Maxwell | |
| 4,805,242 | A * | 2/1989 | Bolton | A41D 19/0024 2/160 |
| D347,994 | S | 6/1994 | Hammond | |
| 5,477,633 | A | 12/1995 | Leinberger | |
| 5,704,067 | A | 1/1998 | Brady | |
| 6,360,684 | B1 | 3/2002 | Quaglia | |
| 6,892,951 | B2 | 5/2005 | Goldenberg et al. | |
| 7,168,098 | B2 | 1/2007 | West | |
| 7,614,434 | B2 * | 11/2009 | DeMichele | A45C 1/08 150/145 |
| D677,252 | S | 3/2013 | Baum et al. | |
| D701,001 | S | 3/2014 | Daniel | |
| D708,846 | S | 7/2014 | Waldon | |
| 9,271,531 | B2 | 3/2016 | Rothschild et al. | |
| 9,468,243 | B2 | 10/2016 | Rothschild et al. | |
| D799,163 | S | 10/2017 | Greene | |
| D804,179 | S | 12/2017 | Kolstad et al. | |
| D808,644 | S | 1/2018 | Overton | |
| D828,032 | S | 9/2018 | Brundage | |
| 10,080,950 | B2 | 9/2018 | Kelley | |
| D847,133 | S | 4/2019 | Catania | |
| D869,578 | S | 12/2019 | Voigt et al. | |
| D898,354 | S | 10/2020 | Hoffman | |
| D967,624 | S | 10/2022 | Xiao | |
| 11,464,265 | B2 | 10/2022 | Blythe | |
| 11,986,718 | B2 * | 5/2024 | Blythe | A41D 20/00 |
| D1,065,832 | S | 3/2025 | Torres et al. | |
| D1,081,125 | S | 7/2025 | Lawler | |
| 2001/0035443 | A1 * | 11/2001 | Jones | A45C 1/04 224/267 |
| 2004/0128741 | A1 * | 7/2004 | Hayman | G09F 21/02 2/311 |
| 2004/0133967 | A1 * | 7/2004 | West | A41D 27/10 2/247 |
| 2004/0250933 | A1 * | 12/2004 | DeMichele | A45C 1/08 150/145 |
| 2006/0261108 | A1 * | 11/2006 | Watts | A45C 1/04 224/222 |
| 2011/0087144 | A1 | 4/2011 | Lee et al. | |
| 2011/0167536 | A1 | 7/2011 | Kellerhals | |
| 2013/0139068 | A1 | 5/2013 | Bowring | |
| 2014/0151416 | A1 | 6/2014 | Ishihara et al. | |
| 2015/0135405 | A1 | 5/2015 | Rothschild et al. | |
| 2016/0135522 | A1 | 5/2016 | Rothschild et al. | |
| 2016/0206083 | A1 | 7/2016 | Gomez et al. | |
| 2017/0065872 | A1 | 3/2017 | Kelley | |
| 2018/0289114 | A1 | 10/2018 | Wheeler | |
| 2023/0218972 | A1 | 7/2023 | Blythe | |
| 2024/0407487 | A1 | 12/2024 | Taylor | |

OTHER PUBLICATIONS

U.S. Appl. No. 17/573,395, filed Jan. 11, 2022, now, U.S. Pat. No. 11,986,718, May 21, 2024.

"I've been seeing this sort of playbook in the NFL and college and I was wondering what is was called", post by user XD_Electron in subreddit r/nfl, posted 4 years ago (2021), reddit. com [online], [site visited Jul. 16, 2025], Available at URL: https://www.reddit.com/r/nfl/comments/p772cj/ive_been_seeing_this_sort_of_playbook_in_the_nfl/ (Year: 2021).

Drymax Technologies Team Sport Product Line Sheet 2025, revision date Nov. 15, 2024, 8 pages (Year: 2024).

Top Gear Athletes; "Under Armor 3-Window Football Wrist Playbook"; 2025; posted date unknown [online]; retrieved Jul. 11, 2025; Retrieved from internet. https://topgearathletics.com/products/under-armour-3-window-football-wrist-coach-playbook?.

Augelux; "Football Play Wristbands, Triple Window Youth and Adults QB Wristband Playbook", 2025; posted date unknown [online]; retrieved Jul. 11, 2025; Retrieved from internet, https://a.co/d/9C5GsJ2.

* cited by examiner

WRIST PLAY CALLER

CROSS-REFERENCE TO RELATED APPLICATIONS

This application is a Continuation of U.S. patent application Ser. No. 17/573,395 filed on Jan. 11, 2022, the entirety of which is incorporated herein by reference.

TECHNICAL FIELD

The present disclosure is directed to an article to be worn on the body or uniform during participation in a variety of team sports, in military, or industrial settings. The article is a generally tubular construct of knitted or woven fiber or yarns irreversibly coupled to a polymeric base sheet comprising a plurality of second polymeric sheets, forming a plurality of pockets configured to receive textual or visual information.

BACKGROUND

Many athletes who participate in team sports, particularly football players, baseball players, and softball players, wear sport wristbands with transparent pockets on one of their arms or worn on a belt during the activity. These sport wristbands with transparent pockets are often called "wrist coaches" or "play callers." Wrist coaches are worn for many reasons such as sweat absorption and to store and display cards with different plays imprinted upon them. A "play" is a coordinated series of movements by members of the team. The coach of a team usually signals in a coded number with hand or arm signals, or cards with photos, and the team member wearing the wrist coach consults the wrist coach and instructs other team members on the play to be executed next. The wrist coach is typically made of blends of fiber or yarn comprising polyester, nylon, spandex, elastane, wool, and/or cotton. The pockets in which the plays are stored, are typically made of a flexible, transparent plastic.

There are disadvantages to wearing the conventional wrist coaches. For example, many team sports are often played outdoors and in a variety of weather conditions. The wrist coaches often become soiled and require frequent washing or replacement. The transparent plastic pockets that are secured onto the wristbands typically become cloudy or may trap water during play and/or after washing, requiring frequent replacement. In some cases, sweat, dew from grass, sports drinks, water, rain or snow can easily enter the plastic pockets from the opening where cards with plays are inserted. Moisture may also enter the plastic pockets from the sewn portions of the wrist coaches, where the stitching has created many holes. As a result of moisture entering the plastic pockets, users often have to plastic laminate both sides of the cards the plays are printed on to protect the paper where plays are printed and to keep ink from running, resulting in extra time and expense. The lamination also results in a much stiffer plastic pocket, causing the wrist coaches to resist contouring to a user's arm and staying closed during play. Further, wrist coaches with detachable pockets may be problematic for athletes, as the pockets and plays that are stored therein, may become detached and/or lost during a contact sport.

SUMMARY

In one aspect, an article comprising at least one tubular construct having a first open end and a second open end is provided. The tubular construct of knitted or woven yarns or fabric comprises at least a first portion and a second portion. The tubular construct has an outer surface having an outer circumference and an inner skin-facing surface having an inner circumference, the inner skin-facing surface separated from the outer surface by a thickness.

In another aspect, alone or in combination with any of the previous aspects, the inner circumference is sized for a secure fit around a wrist and/or lower arm of a wearer.

In another aspect, alone or in combination with any of the previous aspects, the fabric of the tubular construct comprises hydrophobic or hydrophilic fibers. In another aspect, alone or in combination with any of the previous aspects, the fabric comprises hydrophobic and hydrophilic fibers. In another aspect, alone or in combination with any of the previous aspects, the fabric comprises a metal. In another aspect, alone or in combination with any of the previous aspects, the fabric comprises at least one of copper, zinc, silver, and/or an oxide thereof.

In another aspect, alone or in combination with any of the previous aspects, the first portion is a Terry Loop or Pile knit and the second portion is a plain knit.

In another aspect, alone or in combination with any of the previous aspects, the fabric comprises at least one layer of hydrophobic fibers in proximity to the inner skin-facing surface and at least one layer of hydrophilic fibers or a combination of hydrophobic and hydrophilic fibers more distant from the inner skin-facing surface than the layer of hydrophobic fibers. In another example, the article is completely comprised of a hydrophobic fiber.

In another aspect, alone or in combination with any of the previous aspects, the hydrophobic yarn has an elongation to break of less than about 30%. In another aspect, alone or in combination with any of the previous aspects, the hydrophilic yarn is nylon, polyester, or acrylic. In another aspect, alone or in combination with any of the previous aspects, the hydrophilic yarn is cotton, cotton synthetic blended, or wool.

In one example, the article further comprises at least one functional yarn. In one example, the at least one functional yarn is an elastomeric yarn. In one example, the at least one functional yarn is a thermal-regulating yarn. In one example, the inner surface of the article is comprised of a hydrophobic functional yarn and the outer surface of the article is comprised of a hydrophilic functional yarn. In one example, the elastomeric yarn is covered with nylon.

In another aspect, alone or in combination with any of the previous aspects, the article includes a play caller comprising a plurality of polymeric sheets providing pockets. In some examples, the play caller comprises a polymeric base sheet having a length and a width, the polymeric base sheet having a first major surface and a second major surface.

In one example, the polymeric base sheet is a polyethylene vinyl acetate (PEVA). In another example, the polymeric base sheet is a plasticized polyvinyl chloride (PVC).

In one example, a plurality of second polymeric sheets are coupled to the second major surface of the polymeric base sheet, each of the second sheets having a length and a width less than or equal to the length and width of the base sheet, the plurality of second sheets physically separated from each other by a distance defining a plurality of opposing pockets. In another example, the plurality of pockets do not open facing one another. In one example, the plurality of pockets open in an opposite direction from the other.

In one example, the plurality of second polymeric sheets is a polyethylene vinyl acetate. In another example, the plurality of second polymeric sheets is a plasticized polyvinyl chloride.

In one example, each of the plurality of second polymeric sheets are attached to the second major surface of the polymeric base sheet along their widths and a single length, defining a plurality of pockets. The plurality of pockets are configured to receive visual or textual information and at least one of the pockets has a reversible closure system.

In one example, the play caller comprises at least a plurality of tabs that are spatially separated from each other along the width of each of the second polymeric sheets. The plurality of tabs have a fastening member, allowing the tabs to be reversibly fastened to the tubular construct.

In one example, at least a portion of the base sheet and second polymeric sheet assembly is irreversibly coupled to the first portion of the tubular construct along at least a portion of the longitudinal length of the tubular construct.

In one example, there may be multiple sets of a plurality of pockets, wherein each of the plurality of second polymeric sheets are coupled to the second major surface of the polymeric base sheet at substantially the same location along the width of the polymeric base sheet. This assembly allows multiple plurality of pockets to be hingedly coupled along the longitudinal length of the tubular construct.

BRIEF DESCRIPTION OF THE DRAWINGS

In order to understand and to see how the present disclosure may be carried out in practice, examples will now be described, by way of non-limiting examples only, with reference to the accompanying drawings, in which.

DETAILED DESCRIPTION

Figure 1:
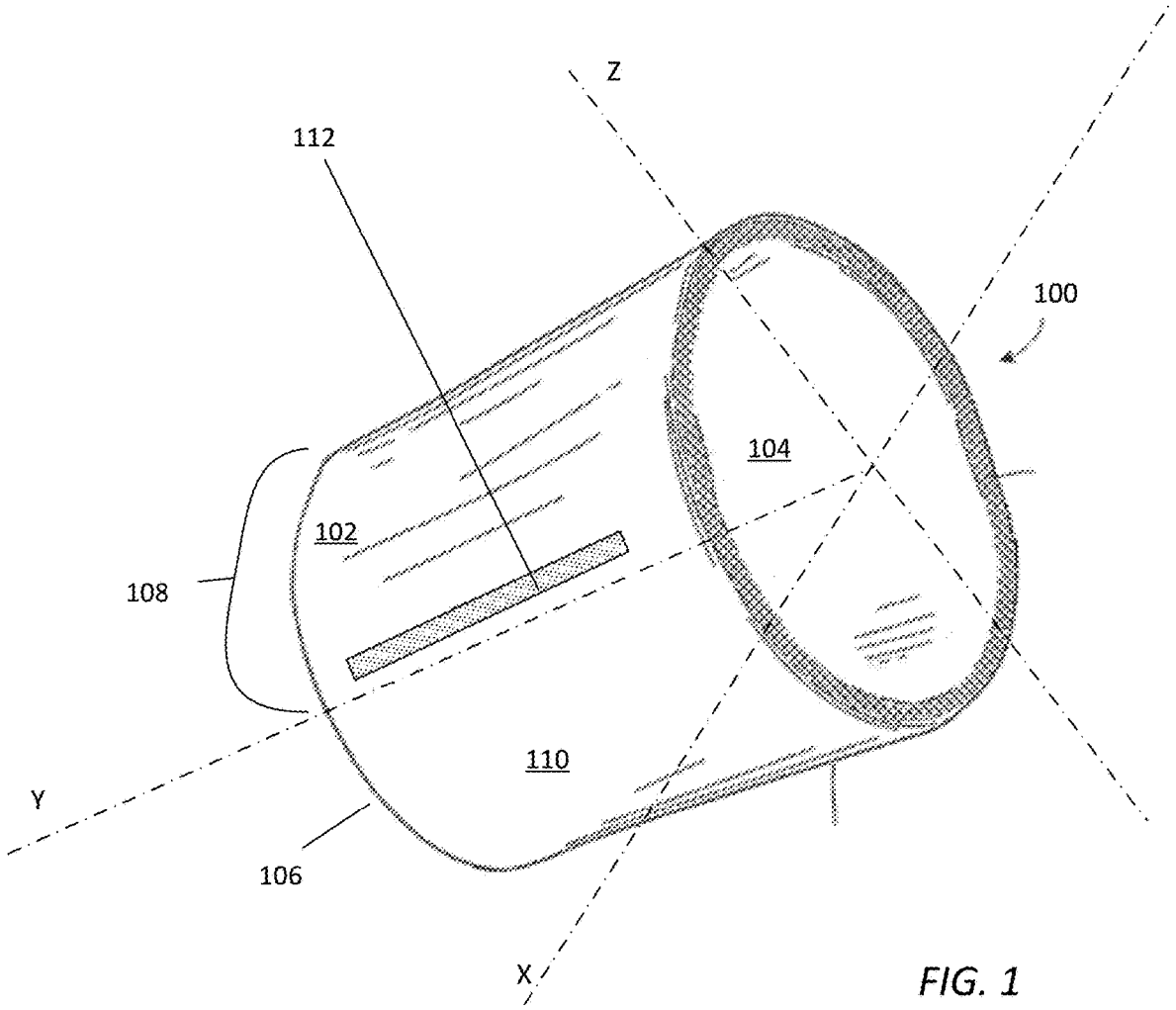
FIG. 1 is a perspective view of an example of the tubular construct as described and disclosed herein, shown relative to an X-Y-Z coordinate axis.

While certain examples of the present disclosure have been illustrated with reference to specific combinations of elements, various other combinations may also be provided without departing from the teachings of the present disclosure. Thus, the present disclosure should not be construed as being limited to the particular exemplary embodiments described herein and illustrated in the Figures but may also encompass combinations of elements of the various illustrated examples and aspects thereof.

Loss of an athlete's play cards can affect the athlete's ability to complete the game and compete effectively. Therefore, there is a need to provide an article with irreversibly secured transparent plastic pockets, made to securely store play cards. Conventional transparent plastic pockets become cloudy after washing and begin to affect the athlete's ability to see and read the plays, further hindering the athlete's ability to compete effectively. Therefore, there is also a need to provide an article with transparent pockets that do not become cloudy after frequent washing.

Throughout this specification, "play caller" is used interchangeably with "wrist coach."

As used hereafter, fiber, yarn or ply are collectively referred to as "yarn."

As used herein, the phrase "team sports" is inclusive of football, basketball, rugby, field hockey, soccer, lacrosse, wrestling, baseball, softball, or any other sport in which players typically wear wrist coaches, and military or industrial uses.

As used herein, the term "tubular" encompasses a tube shape, e.g., a hollow, elongated body or part with an internal diameter, an external diameter, and a length, including an elongated body or part with constant or fixed internal and external diameters along its length. Tubular encompasses an elongated body or part with variable internal and external diameters along its length, where the ratio of the internal and external diameters are substantially constant along the length or where the ratio of the internal and external diameters vary along the length. With regard to a knitted tubular construct, it is understood that variations in yarn and fiber thicknesses, among other variables during the knitting operation, can provide for slight variations in the internal diameter and external diameter along the length of the elongated body or part, such that the terms "constant or fixed" are understood to encompass such variation. Likewise, it is understood that variations in variables during the knitting operation can provide for deliberate variations in the internal diameter and external diameter along the length of the elongated body or part, either in a fixed ratio of such diameters or with variation in the ratios of such diameters so as to accommodate the tubular construct to accept and/or receive cuff or collars of various dimensions.

Used herein, the phrases "inner surface," and "inner portion" with reference to the tubular construct of the article, refers to the surface(s) of the tubular construct in direct contact with or facing the skin of the appendage when the article of clothing is worn as intended. The phrases "inner section," and "inner portion," with reference to the tubular construct, are used interchangeably.

As used herein, the phrases "outer surface" and "outer portion" with reference to tubular construct of the article refers to the surface(s) of the tubular construct not in direct contact with or facing the skin of the appendage when the article of clothing is worn as intended. The phrases "outer section," and "outer portion," with reference to the tubular construct, are used interchangeably.

As used herein, the term "fabric" refers to any material made through weaving, knitting, spreading, crocheting, or bonding. In one aspect, a fabric is inclusive of any material made through knitting or crocheting that may be used in production of an article i.e., garment.

As used herein, the terms "welt" and "knit" as well as their grammatical equivalents are used herein interchangeably.

As used throughout this application, the term "hydrophilic yarns" and its grammatical equivalents mean yarns having an affinity for moisture and/or water or readily adsorbing, absorbing, or wicking water, or liquid compositions of biological origin comprised mostly of water, e.g., sweat and/or perspiration. The hydrophilic properties of the yarn may be intrinsic to the materials used to form the yarn, or the hydrophilic properties may be imparted to the yarn by treating the yarn with one or more hydrophilic compositions. In another example, the hydrophilic properties may be imparted to the yarn by increasing the surface area of the yarn, or by decreasing the size of the yarn and increasing the number of filaments in the yarn.

As used throughout this application, the term "hydrophobic yarns" and its grammatical equivalents mean yarns having essentially no affinity for moisture and/or water or that essentially resist adsorbing or absorbing water, or liquid compositions of biological origin comprised mostly of water, e.g., sweat and/or perspiration. The hydrophobic properties of the yarn may be intrinsic to the materials used to form the yarn, or the hydrophobic properties may be imparted to the yarn by treating the yarn with one or more hydrophobic compositions.

When an element or layer is referred to as being "on," "engaged to," "connected to," or "coupled to" another element or layer, it can be directly alongside, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

In some examples, the article comprises a tubular construct that is of a stretchable, crosswise plain-knit welt symmetrical with a crosswise Terry loop or pile knit construction of approximately three to seven (3-7) inches (7.62-17.78 cm) in diameter and about one to eight (1-8) inches (2.54-20.32 cm) in length. Other lengths can be used.

In some examples, the tubular construct is configured having a first portion of a first thickness about the circumference and/or the length, and a second portion of a second thickness is different from that of the first thickness about the circumference and/or the length. In such a configuration, the tubular construct can be worn with a thinner portion predominately on one side of the wrist or arm and a thicker portion on the opposite side of the wrist or arm. In some examples the thinner portion is worn on the inner side of the wrist e.g., adjacent the palm side of the hand. In this configuration, the thinner portion of the tubular construct allows for greater clearance so as to not obstruct an object held in the user's hand, such as a ball, football, bat, stick or other sporting equipment. In addition, the thinner inside of the wrist of the presently disclosed sweatband may be more comfortable to an athlete wearing a glove, mitt, or a brace, as it may reduce pressure against the glove, mitt or brace as well as the wrist area. Thus, the present tubular construct, when configured as a wristband would provide for more range of motion than conventional wristbands that are of a substantially uniform thickness.

An exemplary representation of the article 100 is shown in FIG. 1. The article 100 comprises a tubular construct 102. The tubular construct 102 is intended to be worn on a mammalian arm or wrist. The tubular construct 102 can be knit on a circular knitting machine of the type which permits selected courses to be plain or flat knit and selected courses to be Terry loop or pile knit, to the completion of a seamless tubular construct of desired circumference and length. When worn as intended on an arm, the tubular construct 102 has two portions, one portion is on the outer side of the arm, and the inner portion of the arm.

In some examples, the tubular construct 102 has a thick and a thin section that extends along the longitudinal axis thereof, for example, to present a thick surface along the longitudinal axis of one side of the tubular construct 102. In some examples, the tubular construct 102 is of uniform thickness.

In some examples, the article 100 comprises a tubular construct 102 that is of a stretchable, crosswise plain-knit welt symmetrical with a crosswise Terry loop or pile knit construction. Preferred fibers used in constructing the tubular construct 102 are selected from natural fibers such as cotton because of its durability and absorbency, but, cotton blends can be used, such as cotton/polyester, cotton/nylon, cotton/acrylic, or many other such blends of natural and manmade fibers. One or more elastic yarns can be incorporated to improve stretchability and a snug fit on the wearer. The yarns can be of 100% cotton, cotton/synthetic, or other combinations of natural or synthetic yarn blends. One hundred percent cotton yarn provides the greater absorbency and durability, but any desired blend of natural and/or synthetics fiber yarn is satisfactory. As with any selection of yarn to be worn on the body, it is desirable to lay in or knit in a spandex or other elastic yarn to improve the stretch fit. Although the plain knit stitch will provide some stretch, the introduction of an elastic yarn will substantially improve fit and performance.

As shown in FIG. 1 the article 100 comprises a tubular construct 102 of knitted or woven yarns having a first open end 104 and a second open end 106. The tubular construct 102 generally comprises a welt having a first portion 108 and a second portion 110 along the longitudinal length (as shown by the Y axis). In one example, the tubular construct 102 comprises a fastening member 112 extending longitudinally along the tubular construct 102, beginning adjacent to the first open end 104 and terminating adjacent to the second open end. In one example, the fastening member 112 is continuous. In one example, the fastening member 112 is discontinuous. In one example, the fastening member 112 extends longitudinally along the tubular construct 102, substantially parallel to the Y axis. In one example, the fastening member 112 extends laterally along the tubular construct 102, substantially parallel to the X axis. In one example, the fastening member 112 comprises a hook and loop fastening system, e.g., VELCRO®. In another example, the fastening member 112 comprises a pressure sensitive adhesive. In one example, the fastening member 112 comprises magnets.

Figure 2:
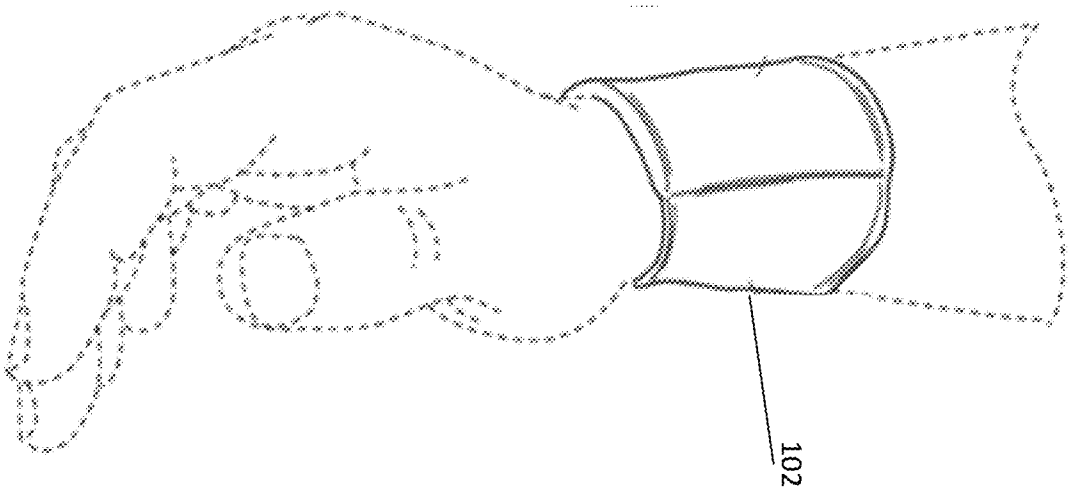
FIG. 2 is a perspective view of the tubular construct of FIG. 1, configured as a wristband, illustrating a manner in which it can be worn and as it may appear when extended over the wrist area and a portion of the lower arm.

In some examples, the tubular construct 102 is adapted to be worn around the arm or wrist, as illustrated in FIG. 2. In another example, the tubular construct 102 can be threaded with a belt and worn about the waist.

In one example the tubular construct 102 of the article 100 includes at least one functional fiber, yarn, or ply. Examples of functional fiber, yarn, or ply are fiber, yarn, or ply having elasticity, moisture management, antimicrobial, and/or thermal-regulation properties when used in making knitted articles. Example of a functional fiber, yarn, or ply having elastic functional fiber, yarn, or ply includes nylon and/or polyester fiber, yarn, or ply. An exemplary elastic fiber, yarn, or ply includes spandex, elastane, LYCRA®, CREORA®, and the like.

An example of a functional fiber, yarn, or ply is a hydrophobic functional fiber, yarn, or ply. An exemplary hydrophobic functional fiber, yarn, or ply includes polypropylene. In another example, the hydrophobic functional fiber, yarn, or ply includes polypropylene having infused metal or a metal coating. In another example, the hydrophobic functional fiber, yarn, or ply includes polypropylene that is not infused with a metal or metal coating. In one example, the at least one functional fiber, yarn, or ply is hydrophilic fiber, yarn, or ply, for moisture-absorbing or adsorbing. Examples of hydrophilic functional fiber, yarn, or ply include cotton and cotton blends, polyesters and nylons. In one example, hydrophilic functional fiber, yarn, or ply can be used, for example, to complement the aforementioned hydrophobic functional fiber, yarn, or ply of tubular body of the article 100. In one example, the inner surface of the tubular body comprises a functional fiber, yarn, or ply, and the outer surface comprises a different functional fiber, yarn, or ply. In one example, the functional fiber, yarn, or ply on the inner surface of the tubular construct is hydrophobic functional fiber, yarn, or ply and the different functional fiber, yarn, or ply on the outer surface is hydrophilic functional yarn.

As no single fiber technology can attract and repel moisture at the same time, in some examples, two different fiber technologies interwoven together to form inner and outer layers can be used. Such combinations of fibers can include hydrophobic (or super-hydrophobic) sweat repelling fibers in combination with water absorbing or adsorbing fibers more distantly positioned from the sweat producing skin. While not to held to any theory, such (super) hydrophobic fibers are technically not "wicking" fibers as they repel rather than transport water. At the molecular level, moisture doesn't adhere to the inner layer of certain hydrophobic fiber terry loop knits. Because sweat (moisture) does not adhere to the hydrophobic fiber, it can be analogized to mechanically lifting the sweat off the skin like a squeegee (as the article 100 is under elastic stress during use, into a moisture attracting outer layer comprised of the hydrophilic fiber without retaining substantial amounts of moisture keeping the wearer's wrist for example, dry and comfortable in or in contact with all types of sports gear, in cold, hot and even wet conditions.

Exemplary play callers 200, 250, 300, 350, 400, 450, and 500 are shown in FIGS. 3A-3G. In one example, the play caller is a flexible, water resistant, or waterproof material that conforms to a tubular construct when worn by a user, as discussed further below.

Figure 3A:
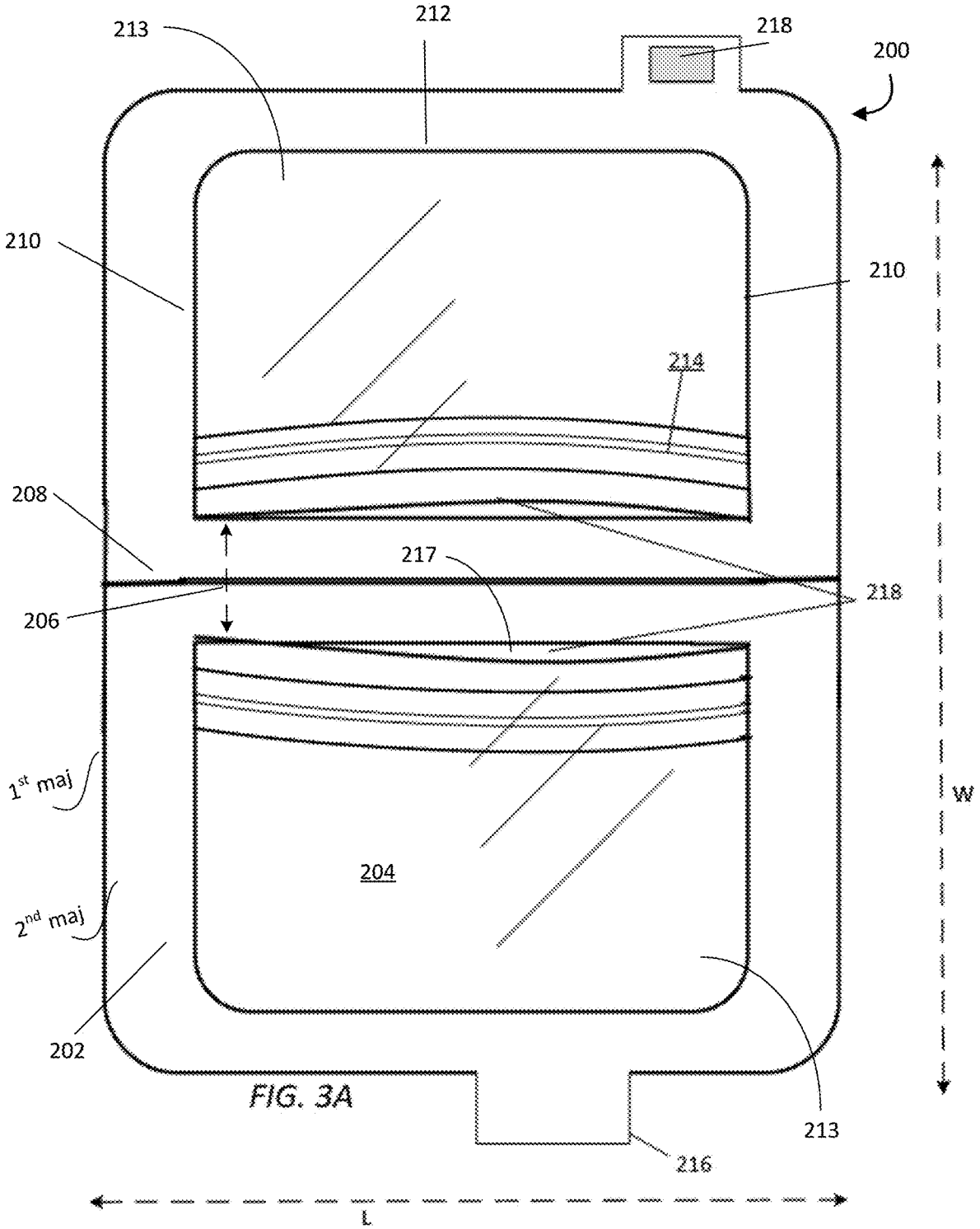
FIG. 3A is an exemplary representation of the play caller, where the play caller is presented with reversible closure systems attached thereto.

With reference to FIG. 3A, an exemplary play caller 200 having pockets 213 with opening 217 along length 212. In one example, the pockets 213 are formed from a polymeric base sheet 202 having a length 212 and a width 210, the polymeric base sheet 202 having a first major surface and a second major surface. Adjacent to the second major surface is a plurality of second polymeric sheets 204, each having a length and a width less than or equal to the length and width of the polymeric base sheet 202, the plurality of second polymeric sheets 204 separated by a distance 206. Parallel to the lengths of the polymeric base sheet 202 and the lengths of the plurality of second polymeric sheets 204 is a heat pressed, marked midline 208, defining a midpoint of a distance 206 between the plurality of second polymeric sheets 204. Each of the plurality of second polymeric sheets 204 are attached to the second major surface of the polymeric base sheet 202 along their widths 210 and a single length 212, defining individual pockets 213. The plurality of second polymeric sheets 204 and the polymeric base sheet 202 are attached to define a plurality of pockets 213 with openings 217 facing or adjacent to the other. In one example, the attachment of the second polymeric sheets 204 to the polymeric base sheet 202 is accomplished by heat seal. In another example, the attachment of the second polymeric sheets 204 to the polymeric base sheet 202 is accomplished by adhesive.

At least one reversible closure system 214 is provided parallel to the heat pressed, marked midline 208. The reversible closure system 214 is provided at a distance that allows for closure of the play caller 200.

The heat pressed, marked midline 208 provides a hinge axis about which the play caller 200 can be folded. In one example, a folded configuration allows the second polymeric sheets 204 to come into contact with each other. In this example, the reversible closure systems 214 are hidden from view. When the play caller 200 is folded in this way, water, moisture, and debris from the environment will not be able to enter through the reversible closure systems 214.

The reversible closure system 214 is any joining method that is attachable and detachable by hand. In one example, the reversible closure system 214 is an interlocking plastic closure strip, such as those found on ZIPLOC® food storage bags. In another example, the reversible closure system 214 is a series of snaps or buttons. In another example, the reversible closure system 214 is comprised of sticky tape. In another example, the reversible closure system 214 is a series of magnetic closures.

The play caller 200 is configured to receive text, visual media, indicia or graphics, for example, presented on paper or other media through a plurality of openings, wherein the openings are capable of being closed by the reversible closure system 214, such that when the reversible closure system 214 is closed, a hermetic seal is formed that protects the text, visual media, indicia or graphics placed inside the play caller 200.

With continued reference to FIG. 3A, in one example, the play caller 200 is further comprised of a plurality of tabs 216. The plurality of tabs 216 are directly adjacent to each length 212 of the polymeric base sheet 202. In one example, the plurality of tabs 216 are die cut so as to be continuous with the polymeric base sheet 202. Alternatively, the plurality of tabs 216 can be adhered or heat pressed and attached to the polymeric base sheet 202 during manufacturing. The plurality of tabs 216 are spatially separated from each other so that when the play caller 200 is folded about the marked midline 208, the plurality of tabs 216 do not overlap each other. In an example, the plurality of tabs 216 contain fastening members 218. The fastening members 218 may comprise a hook and loop fastening system, e.g., VELCRO® system. In another example, the fastening members 218 are a pressure sensitive adhesive.

Figure 3B:
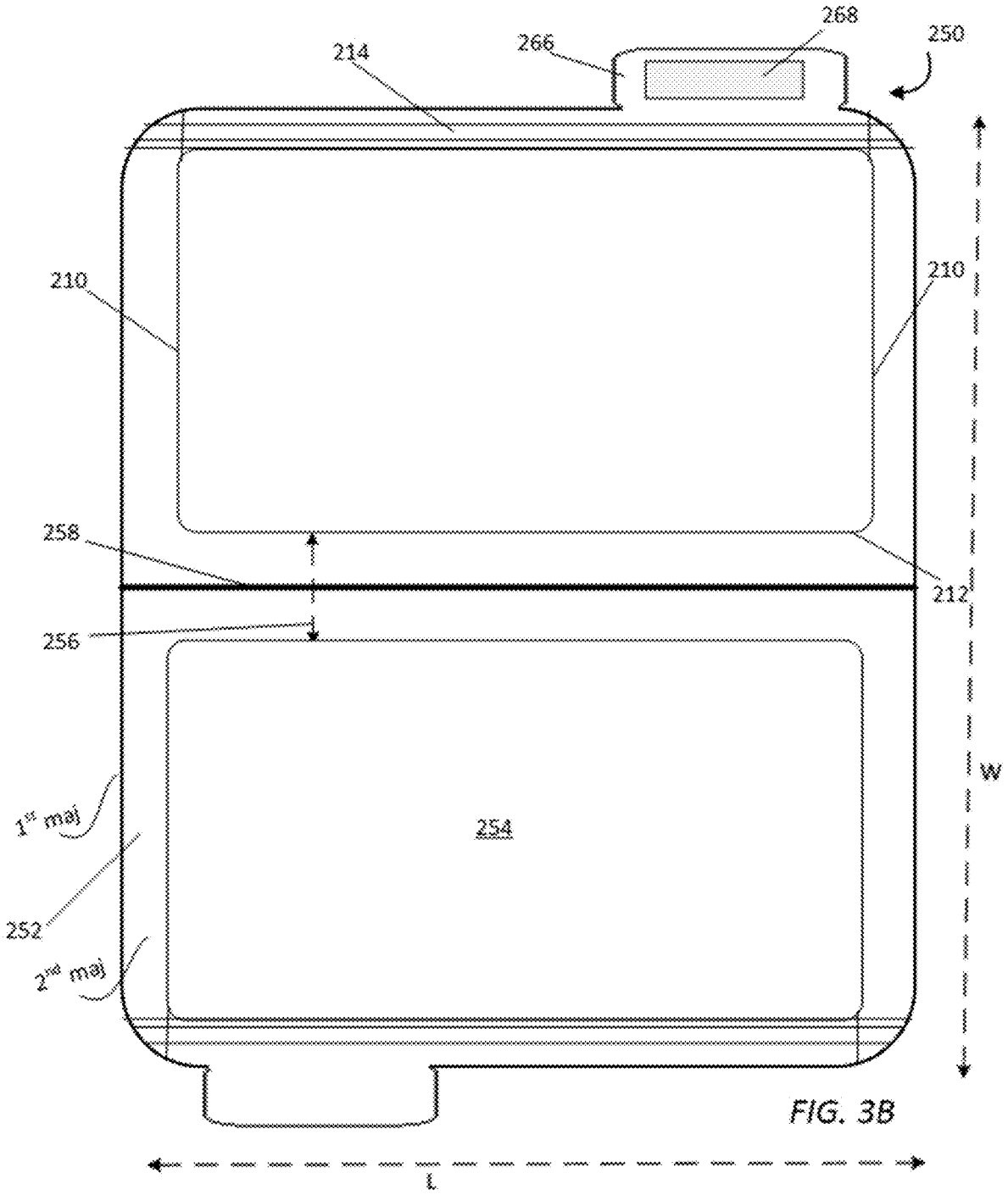
FIG. 3B is an exemplary representation of the play caller, where the play caller has reversible closure systems attached immediately adjacent to the tabs.

With reference to FIG. 3B, an example of play caller 250 is shown. This example of the play caller 250 is formed with a polymeric base sheet 252 having a length and a width, a first major surface and a second major surface. Adjacent to the second major surface is a plurality of second polymeric sheets 254, each having a length and a width less than or equal to the length and width of the polymeric base sheet 252, the plurality of second polymeric sheets 254 separated by a distance 256. Parallel to the lengths of the polymeric base sheet 252 and the lengths of the plurality of second polymeric sheets 254 is a heat pressed, marked midline 258, defining a midpoint of a distance 256 between the plurality of second polymeric sheets 254. Each of the plurality of second polymeric sheets 254 are attached to the second major surface of the polymeric base sheet 252 along their widths 210 and a single length 212, defining a plurality of pockets 213 with opening 217 facing or adjacent to the other. In one example, the attachment of the second polymeric sheets 254 to the polymeric base sheet 252 is accomplished by heat sealing, ultrasonic bonding, or solvent bonding. In another example, the attachment of the second polymeric sheets 254 to the polymeric base sheet 252 is accomplished by adhesive.

In one example, the length and width of the polymeric base sheet 302 is more than 152.4 mm and 98.43 mm, respectively, but not more than 200 mm and 140 mm, respectively. In another example, the length and width of the polymeric base sheet 302 is less than 152.4 mm and 98.43 mm, respectively, but not less than 120 mm and 50 mm, respectively.

At least one reversible closure system 214 is provided parallel to the length of the play caller 250, on the outer edge. The attachments along the widths 210 intersect the at least one reversible closure system 214.

The reversible closure system 214 is any joining method that is attachable and detachable by hand. In one example, the reversible closure system 214 is an interlocking plastic closure strip, such as those found on ZIPLOC® food storage bags. In another example, the reversible closure system 214 is a series of snaps or buttons. In another example, the reversible closure system 214 is comprised of sticky tape. In another example, the reversible closure system 214 is a series of magnetic closures.

The play caller 250 is configured to receive text, visual media, indicia or graphics, for example, presented on paper or other media through opening 217 of pocket 213, wherein the opening 217 are capable of being closed by the reversible closure system 214, such that when the reversible closure system 214 is closed, a hermetic seal is formed that protects the text, visual media, indicia or graphics placed inside the pocket 213 of play caller 250.

The play caller 250 is further comprised of a plurality of tabs 266. The plurality of tabs 266 are directly adjacent to each length 212 of the polymeric base sheet 252. In one example, the plurality of tabs 266 are die cut so as to be continuous with the polymeric base sheet 252. Alternatively, the plurality of tabs 266 are adhered or heat pressed directly adjacent to the polymeric base sheet 252. The plurality of tabs 266 are spatially separated from each other so that when the play caller 250 is folded about the heat pressed, marked midline 258, the plurality of tabs 266 do not overlap each other. In an example, the plurality of tabs 266 contain fastening members 268. The fastening members 268 may comprise a hook and loop fastening system, e.g., VELCRO® system. In another example, the fastening members 268 are a pressure sensitive adhesive. In another example, the plurality of tabs 266 do not contain fastening members 268.

Figure 3C:
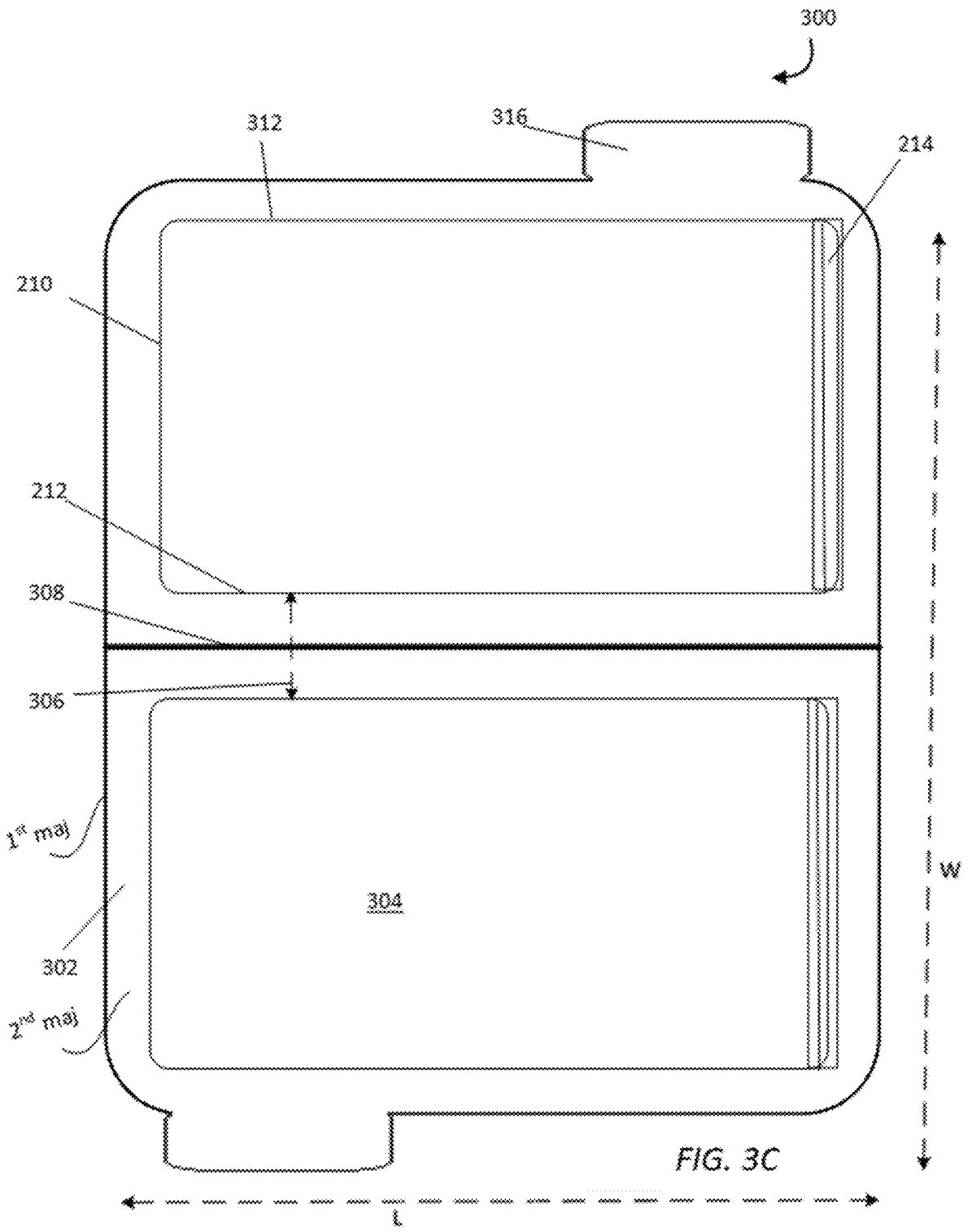
FIG. 3C represents an exemplary representation of the play caller, where the play caller has reversible closure systems attached parallel to a width of the play caller.

With reference to FIG. 3C, a representation of the play caller 300 is shown. This example of the play caller 300 is formed with a polymeric base sheet 302 having a length 212 and a width 210, the polymeric base sheet 302 having a first major surface and a second major surface. Adjacent to the second major surface is the plurality of second polymeric sheets 304, each having a length and a width less than or equal to the length and width of the polymeric base sheet 302, the plurality of second polymeric sheets 304 separated by a distance 306. Parallel to the lengths of the polymeric base sheet 402 and the lengths of the plurality of second polymeric sheets 304 is a heat pressed, marked midline 308, defining a midpoint of the distance 306 between the plurality of second polymeric sheets 304. Each of the plurality of second polymeric sheets 304 are attached to the second major surface of the polymeric base sheet 302 along width 210 and length 212, defining a plurality of pockets 213. The plurality of second polymeric sheets 304 and the polymeric base sheet 302 are attached to define a plurality of pockets 213 with opening 217 along either width.

In one example, at least one reversible closure system 214 is provided along the unattached width (opening 217). The reversible closure system 214 is any joining method that is opened/closed using a hand. In one example, the reversible closure system 214 is an interlocking plastic closure strip, such as those found on ZIPLOC® food storage bags. In another example, the reversible closure system 214 is a series of snaps or buttons. In another example, the reversible closure system 214 is comprised of sticky tape. In another example, the reversible closure system 214 is a series of magnetic closures.

The play caller 300 is further comprised of a plurality of tabs 316. The plurality of tabs 316 are located adjacent to each length 212 of the polymeric base sheet 302. In one example, the plurality of tabs 316 are die cut so as to be continuous with the polymeric base sheet 302. In another example, the plurality of tabs 316 are adhered or heat pressed adjacent to the polymeric base sheet 302. The plurality of tabs 316 are spatially separated from each other so that when the play caller 300 is folded about the heat pressed, marked midline 308, the plurality of tabs 316 do not overlap each other. In one example, the plurality of tabs 316 are ⅓ of the length of the polymeric base sheet 302. In another example, the plurality of tabs 316 are greater than ⅓ of the length of the polymeric base sheet 302. In another example, the plurality of tabs 316 are less than ⅓ of the length of the polymeric base sheet 302.

In an example, the plurality of tabs 316 contain fastening members. The fastening members may comprise a hook and loop fastening system, e.g., VELCRO®. In another example, the fastening members are a pressure sensitive adhesive.

Figure 3D:
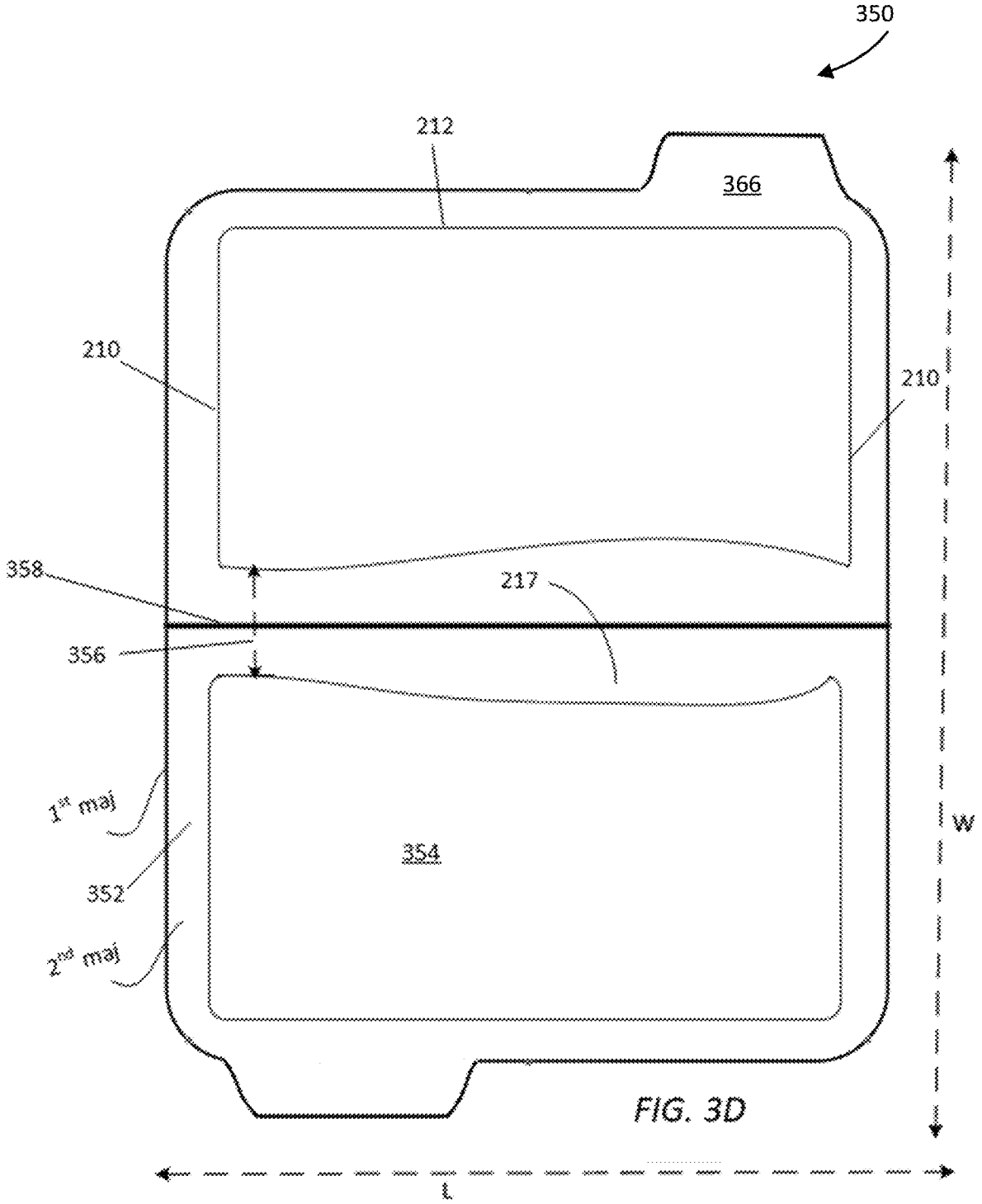
FIG. 3D represents an exemplary representation of the play caller, without the reversible closure systems attached thereto.

With reference to FIG. 3D, the play caller 350 is formed with a polymeric base sheet 352 having a length 212 and a width 210, the polymeric base sheet 352 having a first major surface and a second major surface. Adjacent to the second major surface is the plurality of second polymeric sheets 354, each having a length and a width less than or equal to the length and width of the polymeric base sheet 352, the plurality of second polymeric sheets 354 separated by a distance 356. Parallel to the lengths of the polymeric base sheet 352 and the lengths of the plurality of second polymeric sheets 354 is a heat pressed, marked midline 358, defining a midpoint of the distance 356 between the plurality of second polymeric sheets 354. Each of the plurality of second polymeric sheets 354 are attached to the second major surface of the polymeric base sheet 352 along their widths 210 and a single length 212, defining a plurality of pockets 213. The plurality of second polymeric sheets 354 and the polymeric base sheet 352 are attached to define a plurality of pockets 213, each with opening 217 facing the midline 358.

With reference to FIG. 3D, the play caller 500 is further comprised of a plurality of tabs 366. The plurality of tabs 366 are located adjacent to each length of the polymeric base sheet 352. In one example, the plurality of tabs 366 are die cut so as to be continuous with the polymeric base sheet 352. Alternatively, the plurality of tabs 366 are adhered or heat pressed directly adjacent to the polymeric base sheet 352. The plurality of tabs 366 are spatially separated from each other so that when the play caller 350 is folded about the heat pressed, marked midline 358, the plurality of tabs 366 do not overlap each other. In one example, the plurality of tabs 366 are ⅓ of the length of the polymeric base sheet 352. In another example, the plurality of tabs 366 are greater than ⅓ of the length of the polymeric base sheet 352. In another example, the plurality of tabs 366 are less than ⅓ of the length of the polymeric base sheet 352.

Figure 3E:
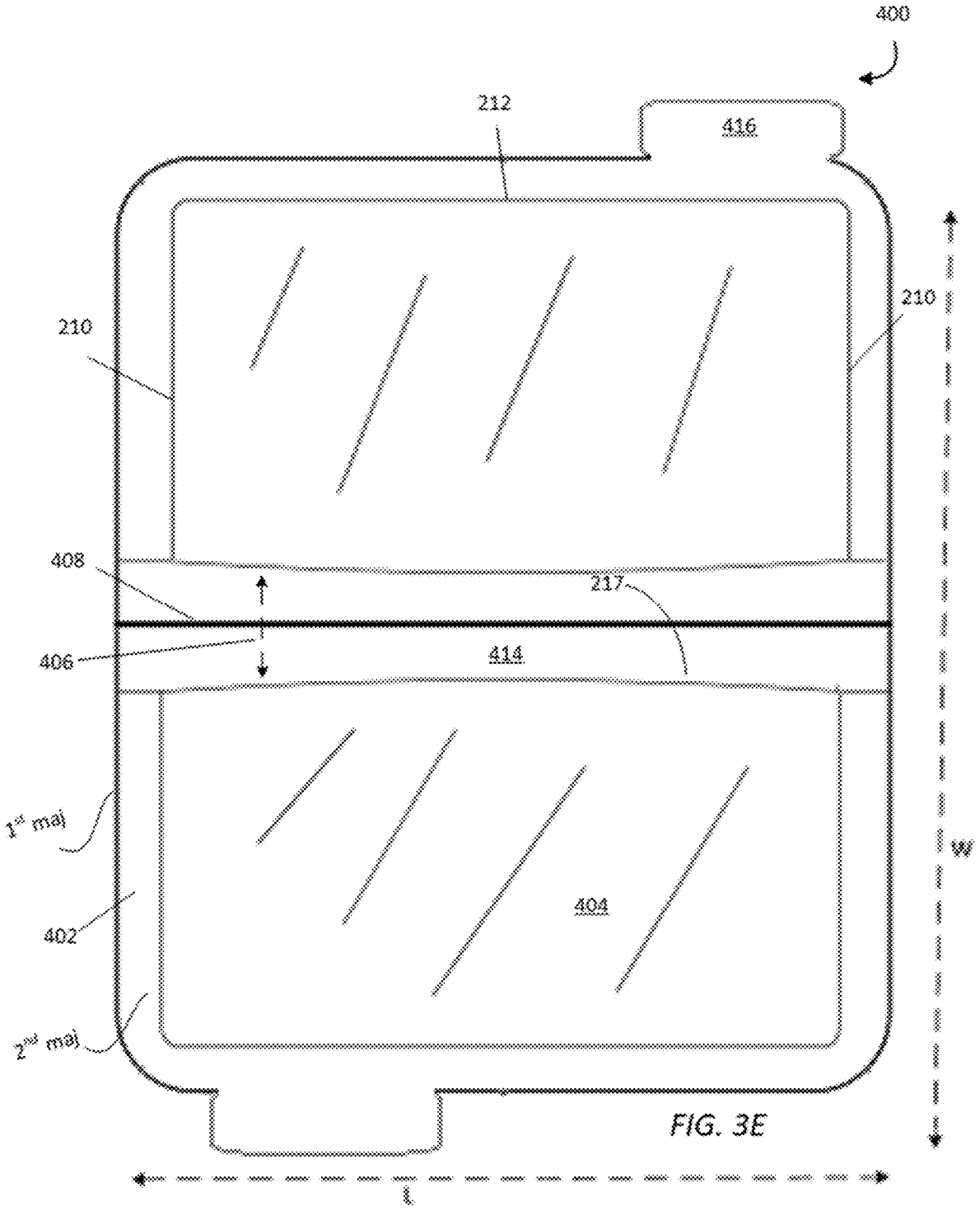
FIG. 3E represents an exemplary representation of the play caller, where the play caller has flaps attached thereto.

With reference to FIG. 3E, an exemplary play caller 400 is formed with a polymeric base sheet 402 having length 212 and width 210, the polymeric base sheet 402 having a first major surface and a second major surface. Adjacent to the second major surface is a plurality of second polymeric sheets 404, each having a length and a width less than or equal to the length and width of the polymeric base sheet 402, the plurality of second polymeric sheets 404 separated by a distance 406. Parallel to the lengths of the polymeric base sheet 402 and lengths of the plurality of second polymeric sheets 404 is a heat pressed, marked midline 408, defining a midpoint of the distance 406 between the plurality of second polymeric sheets 404. Each of the plurality of second polymeric sheets 404 are attached to the second major surface of the polymeric base sheet 402 along their widths 210 and a single length 212, defining a plurality of pockets 213. The plurality of second polymeric sheets 404 and the polymeric base sheet 402 are attached to define a plurality of pockets 213 with opening 217, each facing or adjacent to the other. In one example, the attachment of the second polymeric sheets 404 to the polymeric base sheet 402 is accomplished by heat seal, ultrasonic bonding, or solvent bonding. In another example, the attachment of the second polymeric sheets 404 to the polymeric base sheet 402 is accomplished by adhesive.

In this example, polymeric base sheet 402 includes a plurality of flaps 414 which may be lifted to exposes opening 217 in order to access the pocket 213. In this way, the play caller 400 is configured to receive text, visual media, indicia, or graphics, for example, presented on paper or other media through the plurality of opening 217, wherein the opening is capable of being covered by the plurality of flaps 414. When the plurality of flaps 414 rest over the second polymeric sheets 404, a physical seal is formed that reduces or eliminates egress of water to the text, visual media, indicia, or graphics placed inside the pocket 213 of play caller 400.

In one example, as shown, play caller 400 is further comprised of a plurality of tabs 416. The plurality of tabs 416 are located adjacent to each length of the polymeric base sheet 402. In one example, the plurality of tabs 416 are die cut so as to be continuous with the polymeric base sheet 402. Alternatively, the plurality of tabs 416 are adhered or heat pressed directly adjacent to the polymeric base sheet 402. The plurality of tabs 416 are spatially separated from each other so that when the play caller 400 is folded about the heat pressed, marked midline 408, the plurality of tabs 416 do not overlap each other. In an example, the plurality of tabs 416 contain fastening members 418. The fastening members 418 may comprise a hook and loop fastening system, e.g., VELCRO®. In another example, the fastening members 418 are a pressure sensitive adhesive.

Figure 3F:
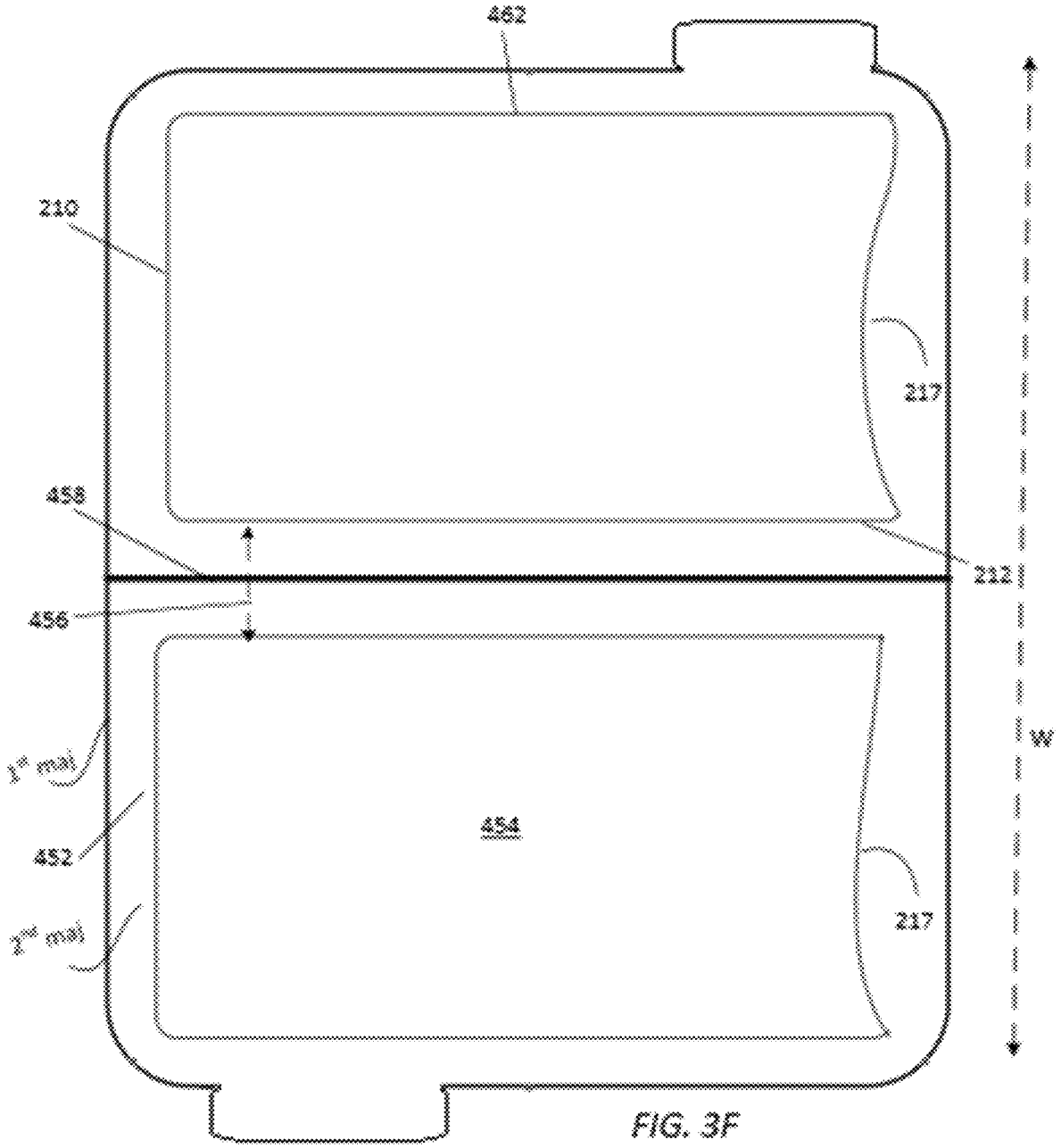
FIG. 3F represents another exemplary representation of the play caller, where the play caller does not have reversible closure systems attached thereto, and open along one width.
Figure 3G:
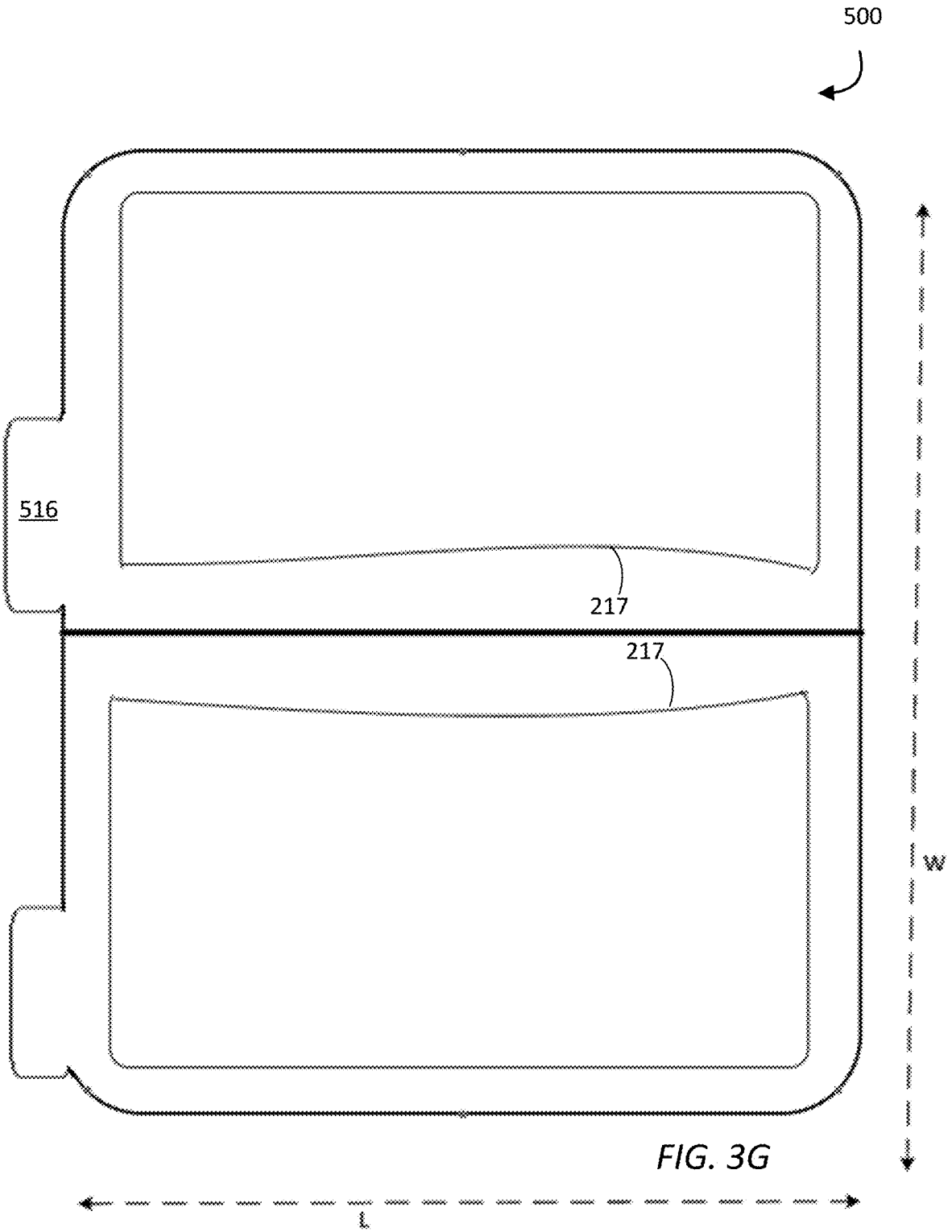
FIG. 3G represents an exemplary representation of the play caller, where the tabs are attached along the width of the play caller.

With reference to FIG. 3F, an exemplary play caller 450 is formed with a polymeric base sheet 452 having length 212 and width 210, the polymeric base sheet 452 having a first major surface and a second major surface. Adjacent to the second major surface is a plurality of second polymeric sheets 454, each having a length and a width less than or equal to the length and width of the polymeric base sheet 452, the plurality of second polymeric sheets 454 separated by a distance 456. Parallel to the lengths of the polymeric base sheet 452 and lengths of the plurality of second polymeric sheets 454 is a heat pressed, marked midline 458, defining a midpoint of the distance 456 between the plurality of second polymeric sheets 454. Each of the plurality of second polymeric sheets 454 are attached to the second major surface of the polymeric base sheet 452 along their a width 210 and their lengths 212, defining a plurality of pockets 213. The plurality of second polymeric sheets 454 and the polymeric base sheet 452 are attached to define a plurality of pockets 213, each with opening 217 facing width 210. In one example, the attachment of the second polymeric sheets 454 to the polymeric base sheet 452 is accomplished by heat seal, ultrasonic or solvent bonding. In another example, the attachment of the second polymeric sheets 454 to the polymeric base sheet 452 is accomplished by adhesive.

In this way, the play caller 400 is configured to receive text, visual media, indicia, or graphics, for example, presented on paper or other media through the plurality of opening 217, wherein the openings are located at width 210.

In one example, as shown, play caller 450 is further comprised of a plurality of tabs 466. The plurality of tabs 466 are located adjacent to each length of the polymeric base sheet 452. In one example, the plurality of tabs 466 are die cut so as to be continuous with the polymeric base sheet 452. Alternatively, the plurality of tabs 466 are adhered or heat pressed directly adjacent to the polymeric base sheet 452. The plurality of tabs 466 are spatially separated from each other so that when the play caller 450 is folded about the heat pressed, marked midline 458, the plurality of tabs 466 do not overlap each other. In an example, the plurality of tabs 466 contain fastening members. The fastening members may comprise a hook and loop fastening system, e.g., VELCRO®. In another example, the fastening members are a pressure sensitive adhesive.

In one example, at least a portion of the plurality of pockets 213 are comprised of a transparent polymeric material. In another example, at least a portion of the plurality of pockets 213 are comprised of a "frosted" polymeric material. As used herein, "frosted" refers to substantially or completely non-transparent. Use of frosted polymeric material for at least a portion of the plurality of pockets 213 provides a level of privacy for the user, where in a first state, textual or visual information is at least partially visually obscured by at least a portion of the frosted pocket 213, and a second state, when the user applies pressure (e.g., finger contact), the textual or visual information is observable by the user. Thus, the frosted material of the play caller allow the user to view the otherwise obscured information on the sheets contained inside the pocket 213 when the user presses the pocket up against the text or visual media inside the pocket (e.g., finger contact) of the play caller. Whereas, in the absence of the contact of the frosted material of the pocket to the text or visual media by the user, the text or visual media inside the pocket 213 is obscured to others.

In one example, the polymeric base sheet 202, 252, 302, 352, 402, 452 or pocket 213 can be any polymer that is either clear or frosted. For example, a polyethylene vinyl acetate material can be used to construct a base sheet 202, 252, 302, 352, 402, 452 and a plurality of second polymeric sheets 204, 254, 304, 354, 404, 454 so as to provide pockets 213. Any polymer that is frosted when relaxed and transparent when pressed up against a surface can be used. In one example, the polymer is frosted on the outside surface and clear on the inside surface. This feature allows for the user to apply pressure to view the plays contained within the play caller but inhibits other competitors from viewing the plays contained within the play caller when pressure is not applied.

Conventional wrist coaches lack transparent frames surrounding the transparent plastic pockets. The lack of transparent frames of a conventional wrist coach obscures information contained on the play cards contained therein. In contrast, pockets 213 of the present disclosure are essentially "frameless" and are of a frosted polymeric material to allow the user to view all or substantially all of the information on the sheets contained inside the pocket.

In one example, any of the previously described play callers 200, 250, 300, 350, 400, 450, and 500 (hereinafter, collectively and interchangeably referred to as "play callers" or "play caller") comprises two, four, six, eight, or more pockets 213, wherein the pockets are commonly hinged together along the heat pressed, marked midline 208, 258, 308, 358, 408, 458. In this example, the pockets 213 are folded about the common hinge axis along the heat pressed, marked midline 208, 258, 308, 358, 408, 458.

Figure 4A:
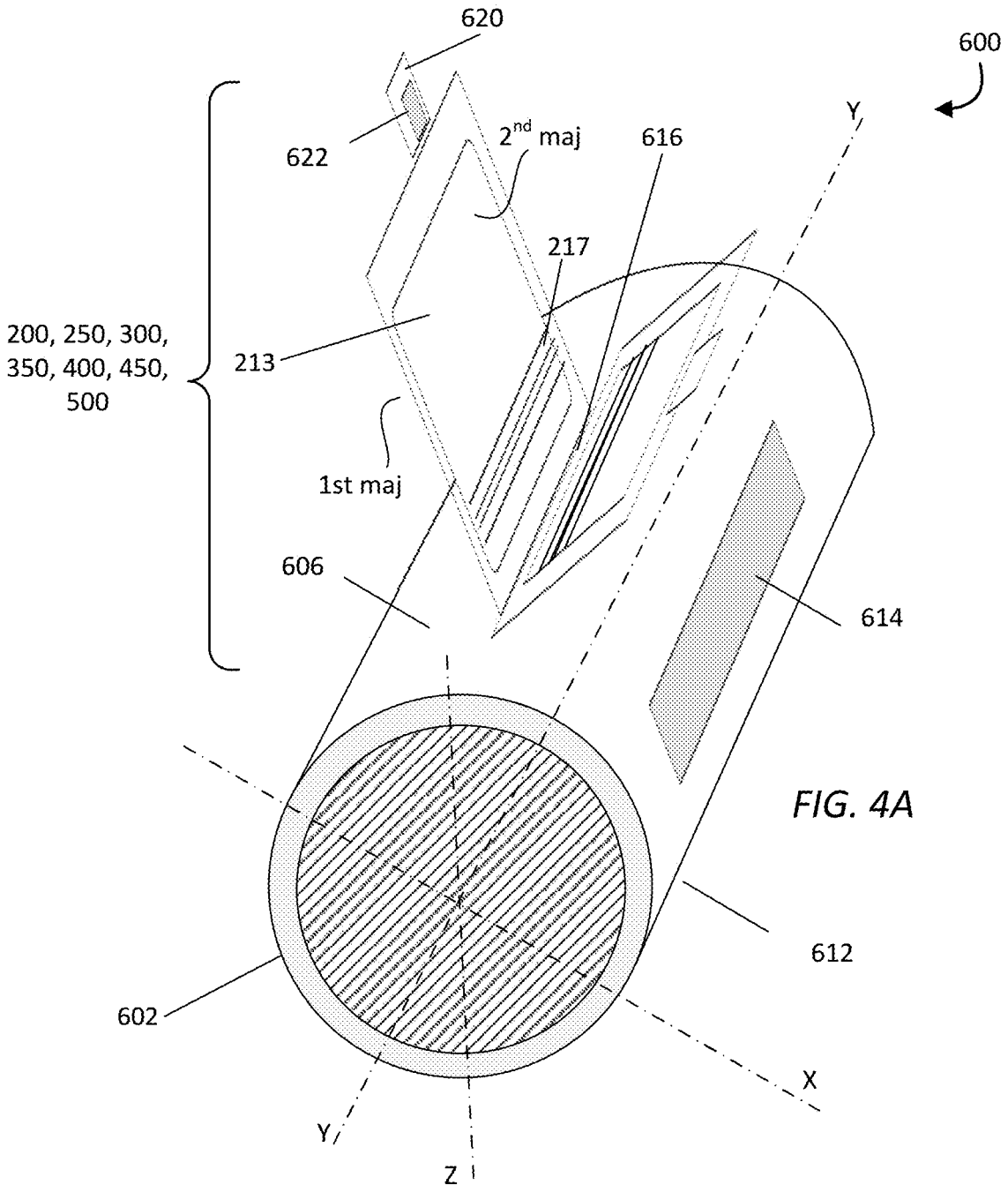
FIG. 4A is an example of the article as disclosed and described in the present disclosure, wherein a play caller is irreversibly coupled to the first portion of the tubular construct along at least a portion of the longitudinal length.
Figure 4B:
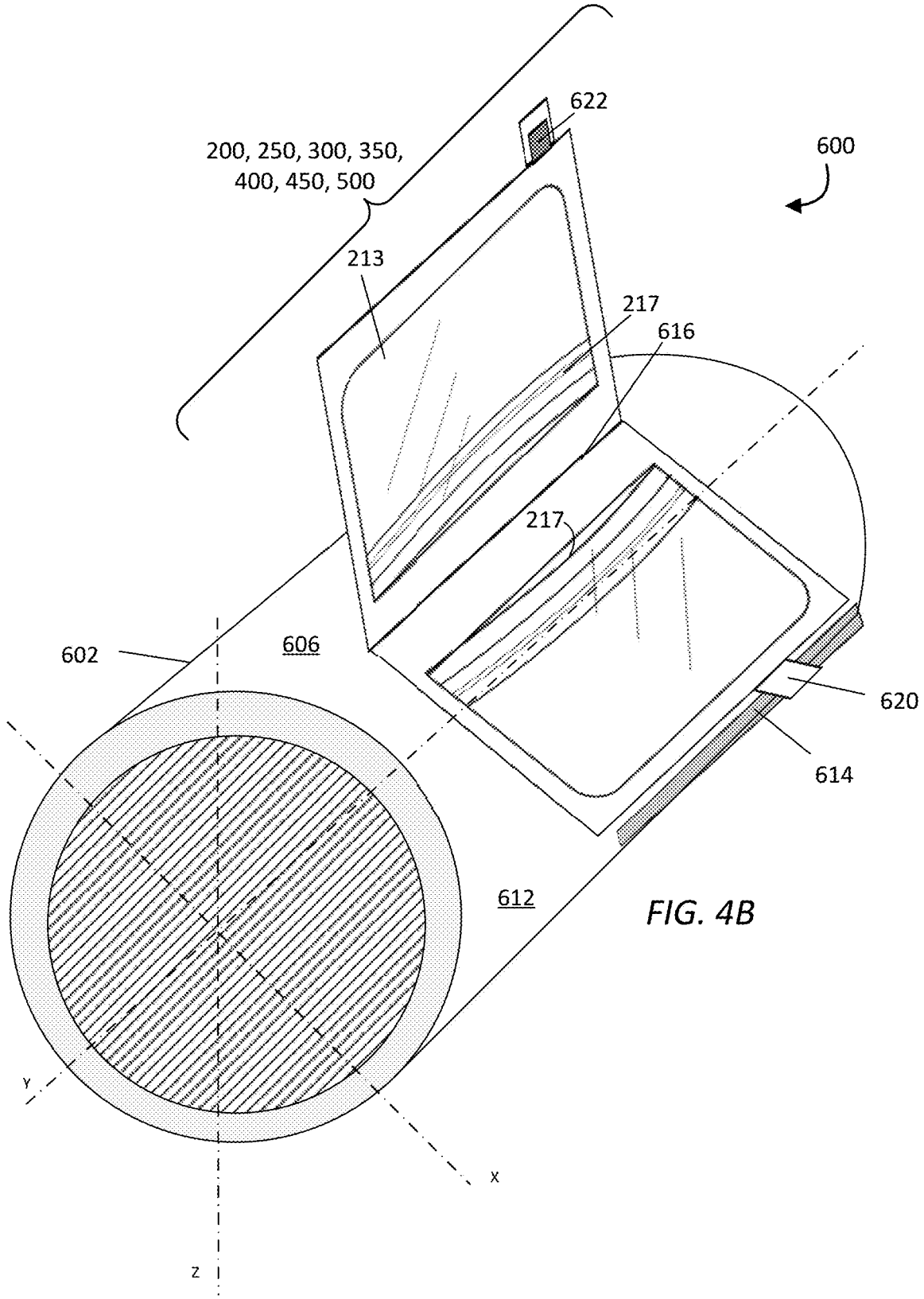
FIG. 4B is an example of the article as disclosed and described in the present disclosure, wherein a play caller is irreversibly coupled along at least a portion of the longitudinal length of the tubular construct, and wherein one of the plurality of tabs is reversibly fastened to the fastening member of the tubular construct.
Figure 4C:
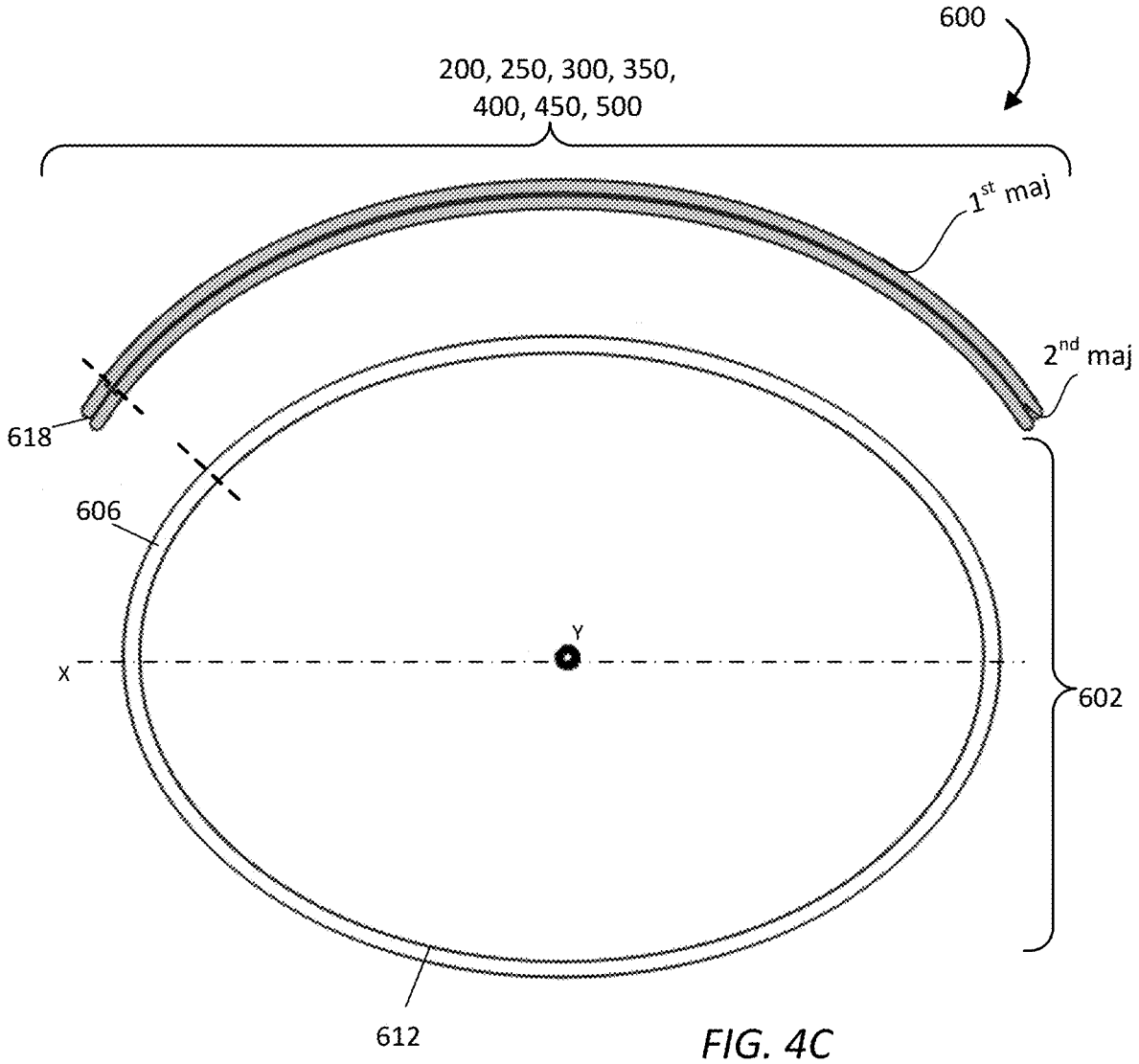
FIG. 4C is a cross-section and exploded perspective of the article as disclosed and described in the present disclosure.

With reference to FIGS. 4A-4C, article 600 comprises any of the previously described play callers and tubular construct 602 reversibly coupled thereto is provided. The tubular construct 602 comprises a first portion 606 and a second portion 612 along the longitudinal length (as shown by the Y axis). In one example, the tubular construct 602 comprises a fastening member 614 extending longitudinally along the tubular construct 602, substantially parallel to the Y axis. In another example, the tubular construct 602 comprises a fastening member 614 extending laterally across the tubular construct 602, substantially parallel to the X axis, to allow stretchability of the tubular construct 602 along the X axis when worn by a user. In one example, the fastening member 614 is a hook and loop fastening system, e.g., VELCRO®. In another example, the fastening member 614 is a pressure sensitive adhesive.

With reference to FIGS. 4A, 4B, and 4C, the play caller is irreversibly, hingedly coupled to the tubular construct 602. In one example, the coupling is achieved on the first portion 606, on a line longitudinally parallel to the Y axis of the tubular construct 602. In another example, the coupling is performed along the heat pressed, marked midline 618 of the play caller. In one example, the irreversible coupling of the play caller to the tubular construct 602 is achieved by stitching.

In one example, the coupling of the play caller to the tubular construct 602 is a stitching of a plain knit. Although the plain knit stitch will provide some stretch, the introduction of an elastic yarn will substantially improve fit and performance of the welt of the tubular construct 602. In another example, the coupling is a stitching of elastic yarn. Elastic yarns include LYCRA®, elastane, spandex, polyurethane, rubber and their blends, and the like.

The coupling of the play caller to the tubular construct 602 using elastic yarn provides for flexibility and longitudinal flex of the tubular construct 602 when the article 600 is worn by a user. The coupling of elastic yarn further prevents or eliminates decoupling of the play caller from the tubular construct 602 during use. The coupling of elastic yarn further prevents tearing of the play caller and/or the tubular construct 602 when the article 600 is deformed by the user.

In another example, the coupling of the play caller to the tubular construct 602 is achieved by an adhesive. In another example, the coupling of the play caller to the tubular construct 602 is achieved by solvent bonding. In another example, the coupling is achieved by ultrasonic welding or any other irreversibly coupling means such as rivets, staples and the like.

The tubular construct 602 and the play caller may be coupled along the entirety of the width of the play caller. For example, the tubular construct 602 and the play caller may be coupled continuously along the heat pressed, marked midline 616. In another example, the coupling is placed at two, three, four, five, six, seven, eight, or more points at a line along the length of the play caller. In another example, the coupling is placed at two, three, four, five, six, seven, eight, or more points along the heat pressed, marked midline 616.

In one example, the coupling is placed only along the middle of the play caller along the width of the play caller, leaving the ends free to promote flex of the article 600.

With reference to FIG. 4A and FIG. 4B, the play caller comprises a plurality of tabs 620, spatially separated from one another. The plurality of tabs 620 are spatially separated so that when the pocket 213 is folded along a line along the length or along the heat pressed, midline 616, the plurality of tabs 620 do not overlap one another. In this example, the plurality of tabs 620 are ⅓ of the length of the play caller. In another example, the plurality of tabs 620 is less than ⅓ of the length of the play caller depending on the number of tabs and pockets 213 attached to the tubular construct 602. In another example, the plurality of tabs 620 is greater than ⅓ of the length of the play caller, depending on the number of tabs and pockets 213 attached to the tubular construct 602.

The plurality of tabs 620 contain fastening members 622 complementary to the fastening member 614 to allow for reversible fastening of pockets 213 with the fastening member 614 of the tubular construct 602. In one example, the fastening member 622 is a hook and loop fastening system, e.g., VELCRO®. In another example, the fastening member 622 is a pressure sensitive adhesive. The strength of the reversible fastening mechanisms between the fastening members 622 and the fastening member 614 of the tubular construct 602, is strong enough to not be separated during a contact sport but can be relatively easily separated by the user.

With reference to FIG. 4B, at least one of the plurality of tabs 620 containing fastening members 622 are shown attached to the fastening member 614 on the tubular construct 602. The at least one of the plurality of tabs 620 comprise fastening members 622 complementary to the fastening member 614 of the tubular construct 602. The strength of the fastening member of the plurality of tabs 620 and the fastening member 614 of the tubular construct 602 can be adjusted as needed to prevent separation during a contact sport, yet relatively easily separated by the user.

In one example, a play caller with two, four, six, eight, or more pockets 213 can be irreversibly coupled to the tubular construct 602. In one example, the plurality of pockets 213 are layered adjacent to each other and are hingedly and irreversibly coupled to the tubular construct 602 along a common axis. In one example, the plurality of pockets 213 are coupled along their heat pressed, marked midlines 616, where it is understood that depending on the exemplary play caller that is being coupled to the tubular construct 602, the heat pressed, mark midline 616 can mean any of the heat pressed, marked midlines 208, 258, 308, 358, 408, 458. In the same example, the common axis substantially longitudinally follows along the Y axis, e.g., along the axis of the arm of the wearer.

Figure 5:
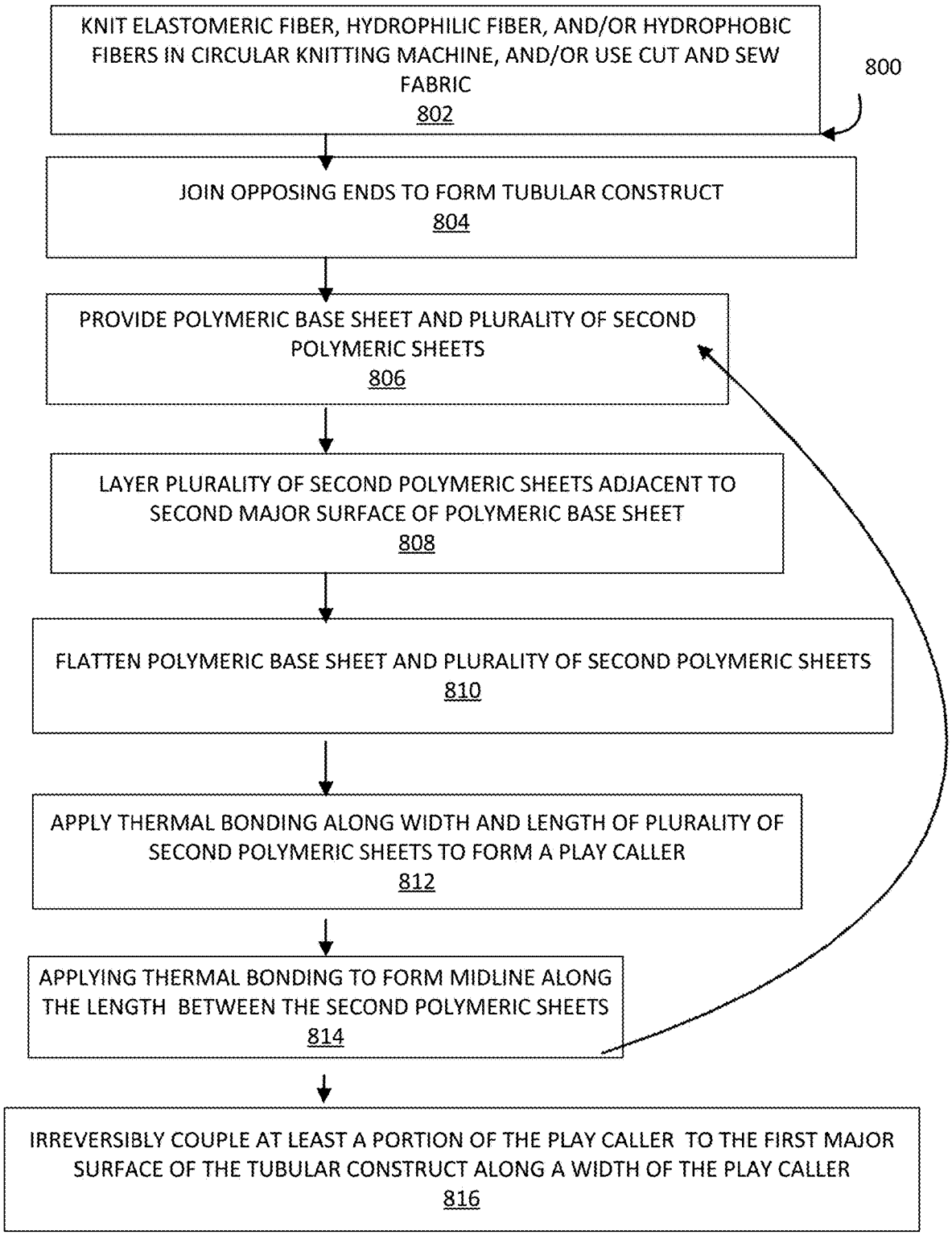
FIG. 5 is a process flowchart of a manufacturing method for providing an example of the article disclosed and described herein.

With reference to FIG. 5, a manufacturing process 800 of an embodiment of the present article is provided. Thus as shown in Step 802, a tubular construct is knitted on a circular knitting machine using elastomeric fiber, hydrophilic fiber, and/or hydrophobic fibers, and/or cut and sew fabric may be used. At the completion of the desired number of courses comprising the tubular construct, the opposing ends are joined to form a tubular construct, as in Step 804. In Step 806, a polymeric base sheet having a first major surface, a second major surface, a length and a width is provided. Also in Step 806, a plurality of second polymeric sheets, each having a length and a width less than or equal to the length and width of the polymeric base sheet are provided. In Step 808, the plurality of second polymeric sheets are laid adjacent to the second major surface of the polymeric base sheet. The plurality of second polymeric sheets are physically separated from each other by a distance, a midpoint of the distance being defined by a midline. In Step 810, the polymeric base sheet and plurality of second polymeric sheets are flattened, in order to rid the assembly of any unwanted wrinkles or bubbles. In Step 812, thermal bonding is applied along the widths and a single length of the plurality of second polymeric sheets, defining a play caller with pockets 213 configured to receive textual or visual information, such as plays. In Step 814, thermal bonding is applied at the midline, to form a crease by which the play caller can be hingedly coupled to the tubular construct. In one example, the midline is the hinged axis about which the play caller can be folded. In another example, any line parallel to the length of the play caller is the hinged axis about which the play caller can be folded.

In one example, Steps 806 to 814 are not repeated and a single play caller is coupled to the tubular construct. In another example, Steps 806 to 814 are repeated to assemble more play callers. In Step 816, at least a portion of the play caller is irreversibly coupled to the first major surface of the tubular construct along a length of the play caller. In another example, at least a portion of the play caller is irreversibly coupled to the first major surface of the tubular construct longitudinally along the midline of the play caller.

In one example, the coupling is a stitching of a plain knit. Although the plain knit stitch will provide some stretch, the introduction of an elastic yarn will substantially improve fit and performance of the welt of the tubular construct. In another example, the coupling is a stitching of elastic yarn. Elastic yarns include spandex, polyurethane, and their blends, and the like.

The coupling of elastic yarn provides for flexibility and longitudinal flex of the tubular construct when the article is worn by a user. The coupling of elastic yarn further prevents or eliminates decoupling of the play caller from the tubular construct during use. The coupling of elastic yarn further prevents tearing of the play caller and/or the tubular construct when the article is deformed by the user.

In another example, the coupling is achieved by an adhesive. In another example, the coupling is achieved by solvent bonding. In another example, the coupling is achieved by ultrasonic welding or any other irreversibly coupling means.

Irreversible coupling between the tubular construct and the play caller may be coupled along the entirety of the width of the play caller. For example, the tubular construct and the play caller may be coupled continuously along the heat pressed, marked midline. In another example, the coupling is placed at two points at a line along the length of the play caller. In another example, the coupling is placed at two points along the heat pressed, marked midline.

In another example, the coupling is placed at two, three, four, five, six, seven, eight, or more points at a line along the length of the play caller. In another example, the coupling is placed at two, three, four, five, six, seven, eight, or more points along the heat pressed, marked midline.

In one example, the coupling is placed only along the middle portion along the length of the play caller, leaving the ends free to promote flex of the article.

Figure 6:
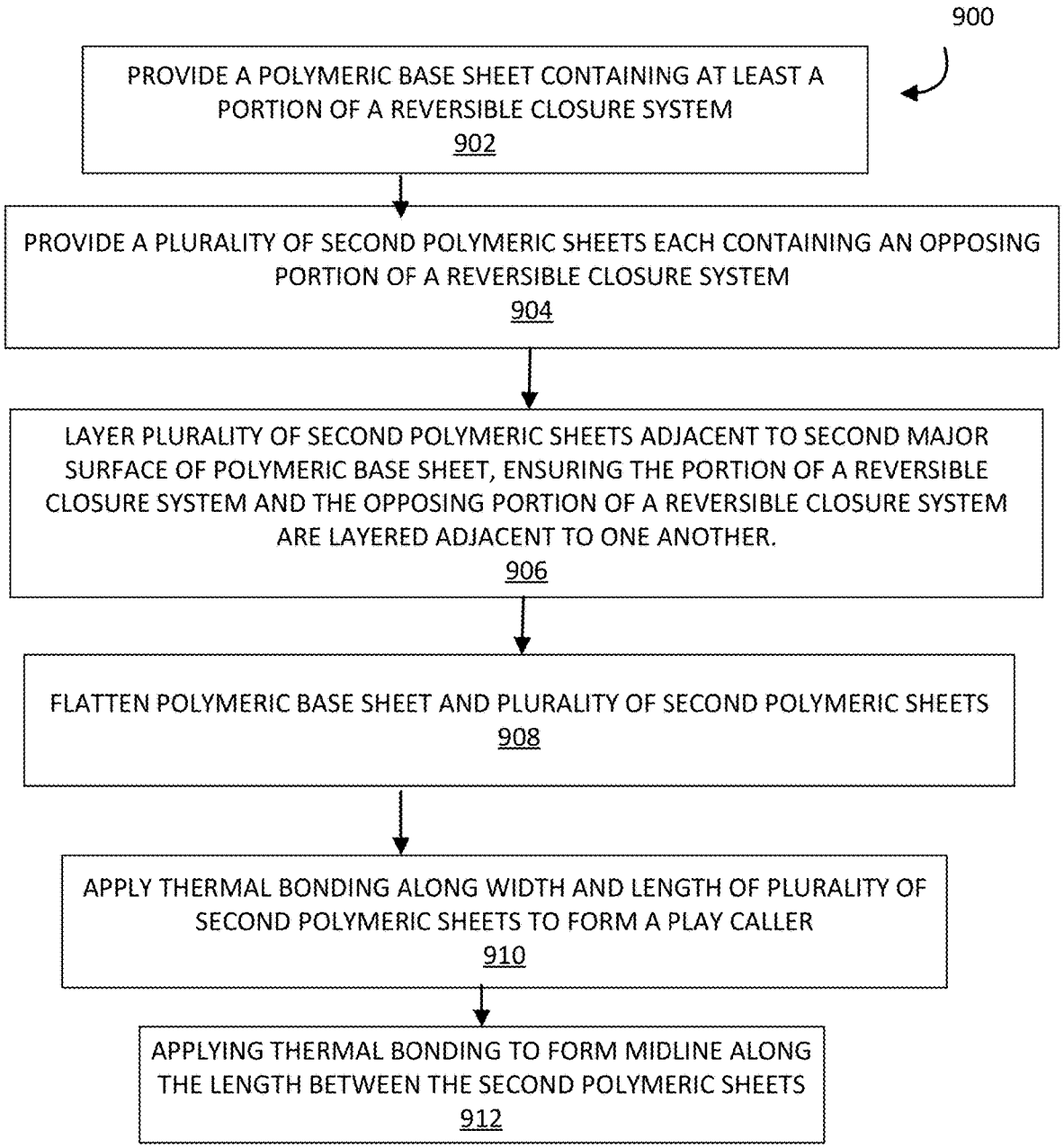
FIG. 6 is a process flowchart of a manufacturing method for providing an example of the play caller disclosed and described herein.

With reference to FIG. 6, a manufacturing process 900 of an exemplary play caller disclosed and described herein is shown. As shown in Step 902, a polymeric base sheet with a first major surface and a second major surface, a length and a width, and containing at least a portion of a reversible closure system on the second major surface is provided. In one example, the portion of a reversible closure system is the portion of an interlocking plastic closure strip, such as those found on ZIPLOC® food storage bags. In another example, the portion of reversible closure system is a series of snaps or buttons. In another example, the portion of reversible closure system is sticky tape. In another example, the portion of reversible closure system is a series of magnetic closures.

In Step 904, a plurality of second polymeric sheets is provided, each containing an opposing portion of a reversible closure system. In one example, the opposing portion of a reversible closure system is the opposing portion of an interlocking plastic closure strip, such as those found on ZIPLOC® food storage bags. In another example, the opposing portion of a reversible closure system is a series of opposing snaps or buttons. In another example, the opposing portion of the reversible closure system is sticky tape. In another example, the opposing portion of reversible closure system is a series of opposing magnetic closures.

In Step 906, the plurality of second polymeric sheets is layered adjacent to the second major surface of the polymeric base sheet, ensuring that the portion of the reversible closure system and the opposing portion of the reversible closure system are layered adjacent to one another. In Step 908, the polymeric base sheet and plurality of polymeric sheets layered adjacent to one another are flattened to ensure there are no wrinkles or bubbles. In Step 910, thermal bonding is applied along the widths and a single length of the plurality of second polymeric sheets, defining a play caller with pockets 213 configured to receive textual or visual information, such as plays. In one example, thermal bonding is applied along the outer single length and widths to configure a play caller with pockets 213 opening toward one another. In another example, thermal bonding is applied along the inner single length and widths of the second polymeric sheets to configure a play caller with pockets 213 that open in an opposite direction to one another. In one example, the thermal bonding is applied to intersect at least a portion of the reversible closure system, leaving a middle portion of the reversible closure system able to be opened. In Step 912, thermal bonding is applied to form the midline along the width between the second polymeric sheets.

Although specific examples have been illustrated and described herein, those of ordinary skill in the art appreciate that any arrangement, which is calculated to achieve the same purpose, may be substituted for the specific examples shown and that the present disclosure has other applications in the environments. This application is intended to cover any adaptation or variations of the present disclosure. The following claims are in no way intended to limit the scope of the present disclosure to the specific examples described herein.

I claim:

1. An article comprising a tubular construct of knitted or woven yarns, the tubular construct having a first portion and a second portion, the first portion having a fastening member;

a play caller comprising a polymeric base sheet having a length and a width, the polymeric base sheet having a first major surface and a second major surface, and at least one pocket having a reversable closure along the length or the width configured to receive textual or visual information;

wherein the play caller is irreversibly coupled to the tubular construct along only one length, the play caller being uncoupled to the tubular construct along its width;

the play caller further comprising at least one tab with a reversible fastening member configured to reversibly couple to the fastening member.

2. The article of claim 1, wherein the reversible closure system is an interlocking plastic closure strip.

3. The article of claim 1, wherein the fastening member comprises a hook or loop fabric.

* * * * *